US009573780B2

(12) United States Patent
La Vos et al.

(10) Patent No.: US 9,573,780 B2
(45) Date of Patent: Feb. 21, 2017

(54) SHEET TRANSPORT ASSEMBLY

(71) Applicant: OCE-TECHNOLOGIES B.V., Venlo (NL)

(72) Inventors: Peter G. La Vos, Venlo (NL); Albert M. Van Beek, Venlo (NL); Johannes H. A. Dinnissen, Venlo (NL); Daisuke Kawaguchi, Venlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 14/952,577

(22) Filed: Nov. 25, 2015

(65) Prior Publication Data

US 2016/0152429 A1 Jun. 2, 2016

(30) Foreign Application Priority Data

Nov. 27, 2014 (EP) ..... 14195103

(51) Int. Cl.
*B65H 5/22* (2006.01)
*B41J 11/00* (2006.01)
(Continued)

(52) U.S. Cl.
CPC ..... *B65H 5/228* (2013.01); *B41J 11/007* (2013.01); *B41J 11/0085* (2013.01); *B65H 5/021* (2013.01);
(Continued)

(58) Field of Classification Search
CPC ..... B65H 29/54; B65H 29/56; B65H 2406/12; B65H 2406/122; B41J 15/048; B41J 11/007; G03G 15/6532
(Continued)

(56) References Cited

U.S. PATENT DOCUMENTS 6,000,695 A * 12/1999 Mack ..... B41F 21/08 271/183
2008/0001347 A1 1/2008 Krause et al.
(Continued)

FOREIGN PATENT DOCUMENTS

DE 10 2007 024 945 A1 12/2007
JP 2000-1239 A 1/2000
(Continued)

*Primary Examiner* — David H Bollinger
(74) *Attorney, Agent, or Firm* — Birch, Stewart, Kolasch & Birch, LLP

(57) ABSTRACT

A sheet transport assembly is provided for transporting a sheet along a process unit configured for applying a process to the sheet. The sheet transport assembly includes: a conveying unit including a transport belt and a deflection element. The transport belt is configured for advancing the sheet in a transport direction along the process unit to the deflection element, the sheet being placed with a contact side on the belt and a process side towards the process unit. The deflection element is arranged in contact with the transport belt to deflect the transport belt downstream in the transport direction relative to the process unit. The sheet transport assembly further includes a separating unit for separating the sheet from the transport belt. The separating unit is connected to an air supply source. The separating unit includes a restrain blowing device arranged for directing a restrain air flow onto the process side of the sheet in a restrain area for urging the sheet towards the transport belt proximate to the deflection element. The separating unit further includes a lifting blowing device arranged for directing a lifting air flow onto the contact side of the sheet in a lifting area for lifting the sheet from the transport belt. The lifting area is arranged extending only over a middle portion of a width of the sheet, the width being a dimension of the sheet in a lateral direction perpendicular to the transport direction.

16 Claims, 7 Drawing Sheets

(51) Int. Cl.
*B65H 5/02* (2006.01)
*B65H 7/16* (2006.01)
*B65H 29/56* (2006.01)

(52) U.S. Cl.
CPC ..... *B65H 7/16* (2013.01); *B65H 29/56* (2013.01); *B65H 2301/4461* (2013.01); *B65H 2301/44735* (2013.01); *B65H 2301/51212* (2013.01); *B65H 2301/51214* (2013.01)

(58) Field of Classification Search
USPC ..... 271/309
See application file for complete search history.

(56) References Cited

U.S. PATENT DOCUMENTS

| | | | |
|---|---|---|---|
| 2010/0052250 | A1 | 3/2010 | Iijima et al. |
| 2011/0157286 | A1 | 6/2011 | Ikegami et al. |
| 2014/0253623 | A1 | 9/2014 | Nakano et al. |

FOREIGN PATENT DOCUMENTS

| | | | |
|---|---|---|---|
| JP | 2002-302323 | A | 10/2002 |
| JP | 2013-227152 | A | 11/2013 |

* cited by examiner

SHEET TRANSPORT ASSEMBLY

FIELD OF THE INVENTION

The present invention relates to a sheet transport assembly for transporting a sheet along a process unit. The present invention further relates to a method for transporting a sheet on a conveying unit along a process unit. The present invention further relates to an inkjet printing apparatus comprising the sheet transport assembly according to the present invention.

BACKGROUND ART

A known sheet transport assembly is applied in an inkjet printing apparatus, wherein a printing station is arranged as a process unit to apply ink on a receiving substrate, such as a sheet. The sheet transport assembly comprises a conveying unit and the printing station comprises an inkjet print head assembly. The conveying unit comprises a transport belt, such as an endless metallic belt, and several rollers arranged for transporting the endless transport belt. A sheet is arranged on the transport belt and is advanced on the transport belt in a transport direction along the printing station wherein an inkjet image is applied onto a process side of the sheet.

The inkjet image is formed by applying dots of an ink, such as an aqueous ink or a non-aqueous ink, on the sheet. In the case of aqueous ink the printed sheet becomes wet on the process side due to the aqueous ink dots. The moisture is absorbed into the sheet and enlarges the fibers of the sheet at the process side of the sheet depending on the sheet properties. As a result an internal tension grows in the sheet, and a portion of the sheet may curl downwards towards the transport belt in case the sheet is not attracted to the transport belt. This may be prevented by attracting the sheet to the transport belt. This attraction may be supplied by an electrostatic force or suction pressure provided at a contact side of the sheet on the transport belt.

The printed sheet is separated from the transport belt by applying a separation air flow to a leading edge of the sheet proximate to a deflection element, such as a roller, which deflection element deflects the transport belt. It is generally known that deflection elements having smaller radius along its deflection surface for deflecting the transport belts provide better separation than deflection elements having a bigger radius along its deflection surface. Said separation air flow is directed along the transport belt adjacent to the deflection element for lifting the leading edge of the sheet from the transport belt at the position of the deflection element. During the separation step the leading edge of the sheet is moved in flight to a next transport element, such as another transport belt. However a curled portion of the sheet being curled towards the transport belt makes it more difficult to separate the leading edge of the sheet from the transport belt. It has been found that the leading edge of the sheet may be pushed backwards at the deflection element by the separation air flow in a direction opposite to the transport direction, thereby further bending the curled portion of the sheet towards the transport belt. As a result, the sheet is not reliably separated from the transport belt, and in the case it is separated, it is not reliably moved over to a next transport element.

It is accordingly an object of the present invention to increase the reliability of separating a sheet from the transport belt, particularly if the sheet has a portion which curls towards the transport belt due to internal tension.

SUMMARY OF THE INVENTION

According to the present invention a sheet transport assembly is provided for transporting a sheet along a process unit configured for applying a process to the sheet, the sheet transport assembly comprising: a conveying unit comprising a transport belt and a deflection element, the transport belt being configured for advancing the sheet in a transport direction along the process unit to the deflection element, the sheet being placed with a contact side on the belt and a process side towards the process unit, the deflection element being arranged in contact with the transport belt to deflect the transport belt downstream in the transport direction relative to the process unit; a separating unit for separating the sheet from the transport belt, the separating unit being connected to an air supply source and comprising a restrain blowing device arranged for directing a restrain air flow onto the process side of the sheet in a restrain area for urging the sheet towards the transport belt proximate to the deflection element and comprising a lifting blowing device arranged for directing a lifting air flow onto the contact side of the sheet in a lifting area for lifting the sheet from the transport belt; characterized in that said lifting area is arranged extending only over a middle portion of a width of the sheet, the width being a dimension of the sheet in a lateral direction perpendicular to the transport direction.

The process that is applied to the sheet may cause internal tension in the sheet, thereby curling the sheet towards the transport belt. The deflection element deflects the transport belt to separate the sheet from the transport belt. The lifting air flow is applied by the lifting blowing device onto the contact side of the sheet in a lifting area for lifting the sheet from the transport belt at the deflection element. The lifting area is arranged extending only over a middle portion of a width of the sheet, the width being a dimension of the sheet in a lateral direction perpendicular to the transport direction. For example, the lifting blowing device, such as an air knife, may comprise a manifold defining an outlet to apply the lifting air flow only onto the middle portion of the width of the sheet.

The restrain air flow is applied onto the process side of the sheet to push the sheet, including a curled portion of the sheet, towards the transport belt. As the restrain air flow pushes the curled portion of the sheet towards the transport belt, the curled portion is flattened. Furthermore, as the restrain air flow extends substantially over an entire width of the sheet, the restrain air flow urges lateral side portions of the sheet towards the transport belt, which lateral side portions are arranged at both sides of the middle portion along the width of the sheet. As a result, an air pressure chamber is formed between the sheet and the transport belt extending over the middle portion of the sheet between both lateral side portions of the sheet. In this way, the lifting air flow provided by the lifting blowing device is better able to lift the middle portion of the sheet from the transport belt even in case of a sheet having a tendency to curl towards the transport belt.

The separating unit is configured to cooperatively apply both air flows to the sheet, thereby reliably separating the sheet from the transport belt. Preferably the separating unit is configured to cooperatively apply both air flows for reliably separating the sheet from the transport belt and move the sheet in a substantially flat state along a transport trajectory to a next transport element, such as a further transport belt.

In an embodiment, said lifting blowing device is a leading edge blowing device arranged for directing a separation air flow along a surface of the transport belt in a direction along the deflected belt at the deflection element towards the leading edge of the sheet for lifting a leading edge of the sheet from the transport belt. The leading edge blowing device, such as an air knife, may be arranged downstream of the transport belt in the transport direction, while directing the separation air flow along the surface of the belt at a curvature of the deflection element. In this position, the leading edge blowing device provides a simple and effective implementation of the lifting air flow of the separating unit. The separation air flow is directed along the deflected belt at the deflection element towards the leading edge of the sheet, i.e. in a direction substantially opposite to the transport direction of the sheet. The separation air flow is especially suitable for stripping the leading edge of the sheet from the transport belt in the lifting area at the deflection element over the middle portion of the width of the sheet.

Furthermore the air knife may comprise a manifold connected to the air supply source, the manifold having an outlet being arranged at an acute angle with respect to the transport direction to direct the separation air flow onto the contact side of the sheet. For example, the air knife is arranged below a predetermined transport trajectory of the sheet from the transport belt to a next transport element, such as a further transport belt. In this position the outlet of the air knife is arranged for facing the contact side of the sheet.

In an embodiment, said lifting blowing device is a detach blowing device arranged for directing a detach air flow through air permeable openings of the transport belt proximate to the deflection element for detaching the sheet from the transport belt. The detach air flow supports lifting of the sheet from the transport belt in the lifting area at the middle portion of the sheet. The detach blowing device, such as an air knife, may be arranged beneath the transport belt at a predetermined position in the transport direction relative to the deflection element. The detach blowing device may comprise a manifold connected to the air supply source, the manifold having an outlet directing the detach air flow through air permeable openings of the transport belt in the lifting area. The outlet is preferably aligned to a centre portion of the transport belt relative to the lateral direction.

In examples, the outlet may be arranged beneath the transport belt upstream of the deflection element and the outlet may be arranged inside the deflection element, such as inside a deflection roller. In this embodiment, the deflection roller accommodates the manifold of the detach blowing device and comprises a plurality of elongated holes extending along a circumferential direction of the deflection roller. The plurality of elongated holes are air permeable openings, which are arranged for communicating the detach air flow from inside the deflection roller through the air permeable openings of the transport belt onto the contact side of the sheet in the lifting area.

In an embodiment, the restrain area is arranged at least extending adjacent to both sides of the lifting area in the lateral direction. In this way, the restrain air flow directed in the restrain area enhances the forming of the air pressure chamber between the sheet and the transport belt extending over the middle portion of the sheet between both lateral side portions of the sheet.

The restrain area may be arranged extending additionally over at least a part of the middle portion of the width of the sheet. In this way, the lifting of the middle portion of the sheet is better controlled, for example by suitably balancing the restrain air flow and the lifting air flow. In an example, the restrain air flow may comprise differing air flow amplitudes along the lateral direction, wherein the restrain area has a region of higher air flow amplitude adjacent to both sides of the lifting area compared to the amplitude of the restrain air flow at the middle portion of the sheet, i.e. at the lifting area. In this way the forming of the air pressure chamber is enhanced.

In an embodiment, said separating unit further comprises a detach blowing device arranged for directing a detach air flow through air permeable openings of the transport belt onto the contact side of the sheet proximate to the deflection element in a second lifting area for detaching the sheet from the transport belt, wherein optionally said second lifting area is arranged extending only over a middle portion of the width of the sheet.

The detach air flow may enhance the lifting of the leading edge caused by the separation air flow, which is provided by the leading edge blowing device. For example, the detach air flow in the second lifting area and the separation air flow in the first lifting area may be cooperatively applied to the contact side of the sheet to increase the air pressure in the air pressure chamber extending over the middle portion of the sheet. Preferably the first lifting area and the second lifting area are aligned to one another along the width of the sheet, i.e. in the lateral direction of the transport belt. In this way, the effect of the air pressure chamber is maximized. A distance between the first lifting area and the second lifting area in the transport direction of the sheet is suitably selected in order to optimize the lifting effect of the air pressure chamber formed by both the lifting air flows provided in the first lifting area and the second lifting area. A restriction of the second lifting area to extend only over a middle portion of the width of the sheet enhances the formation of the air pressure chamber.

In an embodiment, said separating unit further comprises a leading edge blowing device arranged for directing a separation air flow along a surface of the transport belt in a direction from the deflected belt at the deflection element towards the leading edge of the sheet in a second lifting area for lifting a leading edge of the sheet from the transport belt, wherein optionally said second lifting area is arranged extending only over a middle portion of the width of the sheet.

The separation air flow in the second lifting area and the detach air flow in the first lifting area may be cooperatively applied to the contact side of the sheet to increase the air pressure in the air pressure chamber extending over the middle portion of the sheet. Preferably the first lifting area and the second lifting area are aligned to one another along the width of the sheet, i.e. in the lateral direction of the transport belt. In this way, the effect of the air pressure chamber is maximized. A distance between the first lifting area and the second lifting area in the transport direction of the sheet is suitably selected in order to optimize the lifting effect of the air pressure chamber formed by both the lifting air flows provided in the first lifting area and the second lifting area. A restriction of the second lifting area to extend only over a middle portion of the width of the sheet enhances the formation of the air pressure chamber.

In an embodiment, the restrain blowing device is arranged to apply said restrain air flow onto the process side of the sheet upstream in the transport direction with respect to the leading edge blowing device applying the separation air flow onto the leading edge of the sheet. The restrain air flow pushes the curled portion of the sheet towards the transport belt before or substantially at the same time as the leading edge blowing device applying the separation air flow onto the leading edge of the sheet in the lifting area. This arrangement improves the cooperation of both blowing devices for forming and maintaining the air pressure chamber.

In a further embodiment, the detach blowing device is arranged to apply said detach air flow onto the contact side of the sheet upstream in the transport direction with respect to the restrain blowing device applying said restrain air flow onto the process side of the sheet. Said arrangement enhances a cooperative application of the detach air flow, the restrain air flow and the separation air flow on the sheet. In this way, the formation of the air pressure chamber is enhanced. For example the application of said air flows on the sheet may be synchronized, such as substantially at the same time, to reliably separate the sheet.

In an embodiment, the detach blowing device comprises a manifold defining an outlet to apply the detach air flow onto a middle portion of a width of the sheet, the width being a dimension of the sheet in a lateral direction perpendicular to the transport direction. The detach air flow is applied onto the middle portion of the sheet for detaching said middle portion from the transport belt. As a result the middle portion of the sheet is pushed further away from the transport belt than both lateral side portions of the sheet, which lateral side portions of the sheet are arranged at both sides of the middle portion along the width of the sheet. An air pressure chamber is formed between both lateral side portions of the sheet, which air pressure chamber enhances the lifting of the leading edge by the separation air flow at the middle portion of the width of the sheet.

In an embodiment, the separating unit further comprises a sheet guidance element arranged facing the transport belt adjacent to the deflection element to guide the leading edge of the sheet away from the transport belt. Said guidance element enhances the separation of the sheet by guiding the leading edge away from the transport belt after the lifting air flow has at least in part lifted the leading edge of the sheet from the transport belt.

For example, the guidance element may comprise guidance edges arranged facing the surface of the deflected belt at the deflection element. The guidance edges are arranged for lifting the leading edge and the side edges of the sheet from the transport belt and onto a guidance surface of the sheet guidance element. In this way, a further separation of the sheet from the transport belt is enhanced at the leading edge and both sides of the sheet.

In an embodiment, the sheet transport assembly further comprises a sensor unit configured to determine a position of the sheet on the transport belt and to provide a timing signal to the control unit for controlling the at least two blowing devices in response to the timing signal, wherein at least one sheet attribute is provided to the control unit for controlling the at least two blowing devices based on said at least one sheet attribute.

The control unit controls the timing of the at least two blowing devices in response to the timing signal to cooperatively apply the restrain air flow and the lifting air flow onto the sheet, such as synchronize both air flows. The timing signal is provided by the sensor unit to the control unit based on the determined position of the sheet on the transport belt.

The at least one sheet attribute contains information for further improving the separation of the sheet from the transport belt. Based on said at least one sheet attribute the control unit may adjust the timing and/or amplitude of the respective air flows provided by said at least two blowing devices. Said amplitude may be an air flow pressure or may be an air flow volume per time.

Said at least one sheet attribute may comprise a media characteristic of the sheet, such as a media type, a sheet size, a sheet thickness, a media material, a sheet surface type and any other media characteristic. Said at least one sheet attribute may also comprise a sheet process characteristic, such as ink coverage, a process temperature, a process humidity and any other sheet process characteristic.

Said control unit may further comprise a media characteristic database unit and/or a sheet process database unit for determining control settings of the at least two blowing devices based on said at least sheet attribute.

In another aspect of the present invention a method is provided for transporting a sheet on a conveying unit along a process unit, the conveying unit comprising a transport belt and a deflection element arranged in contact with the transport belt to deflect the transport belt, the method comprising the steps of:

a) arranging a sheet on the transport belt, wherein the sheet is placed with a contact side on the transport belt and a process side towards the process unit;
b) advancing the sheet on the transport belt in a transport direction along the process unit to the deflection element to apply a process to the process side of the sheet, which process causes internal tension in the sheet; and
c) separating the sheet from the transport belt, comprising moving the sheet on the transport belt along the deflection element, applying a restrain air flow onto the process side of the sheet in a restrain area for urging the sheet towards the transport belt proximate to the deflection element and applying a lifting air flow onto the contact side of the sheet in a lifting area for lifting the sheet from the transport belt, characterized in that said lifting area is arranged extending only over a middle portion of a width of the sheet, the width being a dimension of the sheet in a lateral direction perpendicular to the transport direction.

By moving the sheet on the transport belt along the deflection element, which deflects the transport belt, a separation of the sheet from the transport belt is enhanced. The lifting air flow is applied onto the contact side of the sheet, such as onto the leading edge of the sheet, for lifting the leading edge from the transport belt at the deflection element. The restrain air flow is applied onto the process side to push a curled portion of the sheet towards the transport belt. As the restrain air flow pushes the curled portion of the sheet towards the transport belt, the curled portion is flattened and the lifting air flow is better able to lift the leading edge from the transport belt even in case of a sheet having a tendency to curl towards the transport belt.

Furthermore, as the restrain air flow extends substantially over an entire width of the sheet, the restrain air flow urges lateral side portions of the sheet towards the transport belt, which lateral side portions are arranged at both sides of the middle portion along the width of the sheet. As a result, an air pressure chamber is formed between the sheet and the transport belt extending over the middle portion of the sheet between both lateral side portions of the sheet. In this way, the lifting air flow provided by the lifting blowing device only at the middle portion of the sheet is better able to lift the middle portion of the sheet from the transport belt even in case of a sheet having a tendency to curl towards the transport belt.

In an embodiment, step c) comprises applying the restrain air flow and lifting air flow substantially at the same time onto the sheet. The synchronized urge on the process side of the sheet enhances the lifting of the sheet from the transport belt at the middle portion of the width of the sheet.

In an embodiment, in step c) the lifting air flow comprises a separation air flow directed along a surface of the transport belt in a direction along the deflected belt at the deflection element towards the leading edge of the sheet for lifting a leading edge of the sheet from the transport belt. The separation air flow is directed along the deflected belt at the deflection element towards the leading edge of the sheet, i.e. in a direction substantially opposite to the transport direction of the sheet. The separation air flow is especially suitable for stripping the leading edge of the sheet from the transport belt in the lifting area at the deflection element over the middle portion of the width of the sheet.

In an embodiment, in step c) the lifting air flow comprises a detach air flow directed through air permeable openings of the transport belt onto the contact side of the sheet for detaching the sheet from the transport belt. The detach air flow is especially suitable for detaching the middle portion of the width of the sheet from the transport belt, even in case the sheet has a sticking behavior towards the transport belt.

In an embodiment, step c) comprises applying the separation air flow and the detach air flow substantially at the same time onto the contact side of the sheet. This improves the formation of an air pressure chamber along the middle portion of the width of the sheet to lift the sheet from the transport belt.

In an embodiment, step c) comprises applying the restrain air flow onto the process side of the sheet upstream in the transport direction with respect to the separation air flow touching the leading edge of the sheet. This arrangement improves the urging effect of the restrain air flow as the urging effect may be started earlier than the separation air flow touching the leading edge and/or the urging force is provided on the process side at a sufficient distance from the leading edge, thereby optimizing the lever between an urging position of the restrain air flow on the sheet and the leading edge of the sheet.

In an embodiment, step c) further comprises applying a detach air flow through the transport belt onto the contact side of the sheet proximate to the deflection element. The detach air flow provides detaching of the sheet from the transport belt.

In an embodiment, step c) comprises applying the separation air flow and the detach air flow substantially at the same time onto the sheet. The detach air flow may also enhances the lifting of the leading edge caused by the separation air flow. As the detach air flow provides a positive air pressure between the transport belt and the curled portion of the sheet, the leading edge is pushed forward in the transport direction and is more easily separated from the transport belt by the separation air flow.

In an embodiment, step c) comprises controlling the at least two air flows in response to at least one sheet attribute of the sheet, wherein the at least one sheet attribute comprises a media characteristic of the sheet.

In an embodiment, step c) comprises directing the restrain air flow substantially perpendicular to a plane of the transport direction onto the process side of the sheet. The angle of the restrain air flow, being preferably in the range of 80-110 degrees, with respect to a plane of the transport direction, may be suitably selected to direct the urging force on the sheet towards the transport belt. The plane of the transport direction of the sheet is determined by the plane of the transport belt.

Further scope of applicability of the present invention will become apparent from the detailed description given hereinafter. However, it should be understood that the detailed description and specific examples, while indicating embodiments of the present invention, are given by way of illustration only, since various changes and modifications within the scope of the present invention will become apparent to those skilled in the art from this detailed description.

BRIEF DESCRIPTION OF THE DRAWINGS

Hereinafter, the present invention is further elucidated with reference to the appended drawings showing non-limiting embodiments and wherein.

DETAILED DESCRIPTION OF EMBODIMENTS

Figure 1A:
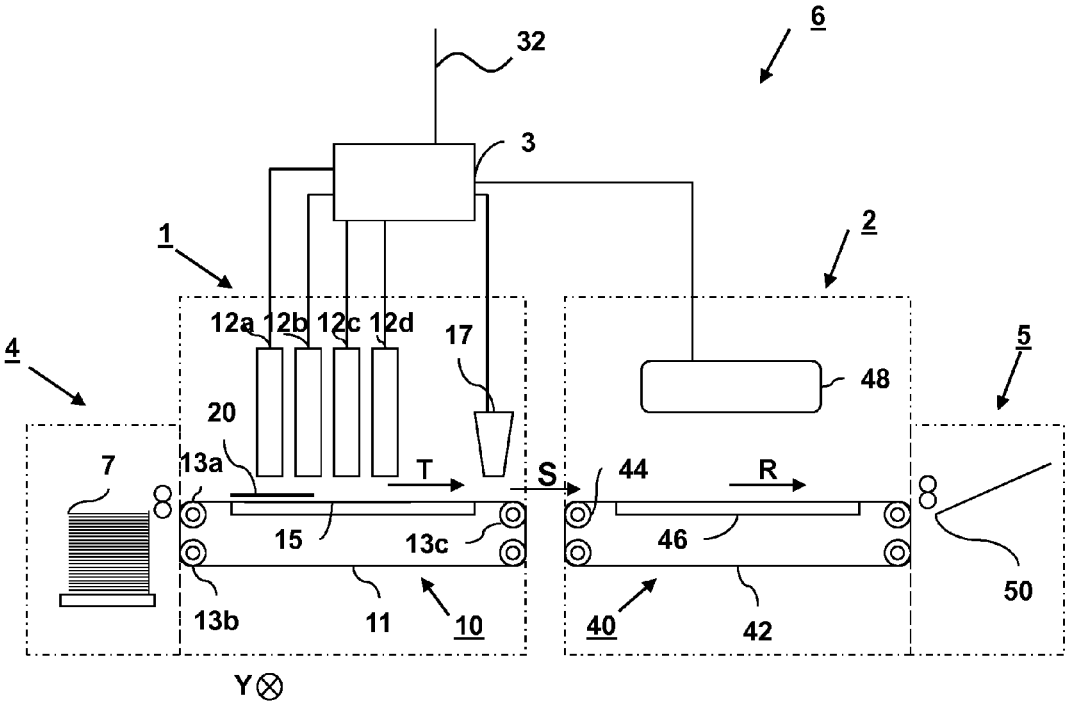
FIG. 1A shows a cut sheet image forming system, wherein printing is achieved using an inkjet printing system.

The present invention will now be described with reference to the accompanying drawings, wherein the same reference numerals have been used to identify the same or similar elements throughout the several views.

In FIG. 1A an inkjet printing system 6 is shown. The inkjet printing system 6 comprises an inkjet marking module 1, an inkjet print drying module 2 and a data controller 3. The controller is connected to a network through a network cable 32. The print data enters the controller through the network and is further processed. The print data can be saved on a non-volatile memory like a hard disk and sent to the inkjet marking module 1 using an interface board (not shown).

A cut sheet supply module 4 supplies a receiving medium 20 to the inkjet marking module 1. In the cut sheet supply module 4 the receiving medium is separated from a pile 7 and brought in contact with the belt 11 of the inkjet marking module 1. The inkjet marking module 1 comprises an assembly of four colour inkjet print heads 12.

The belt 11 transports the receiving medium to the area beneath the four colour inkjet print heads 12*a*-12*d*. The colours provided by the inkjet print heads 12 is black, cyan, magenta and yellow. When receiving the print data, the inkjet print heads 12 each generate droplets of inkjet marking material and position these droplets on the receiving medium 20.

The belt 11 is transported by an assembly of belt rollers 13*a*-13*c*. The belt 11 is transported by one roller belt roller 13*a* in the direction of T, and the position of the belt 11 in the direction y is steered by means of another belt roller 13*b*. The belt 11 comprises holes and the receiving medium 20 is held in close contact with said belt 11 by means of an air suction device 15.

After the inkjet marking material has been printed on the receiving medium, the receiving medium is moved to an area beneath a scanner module 17. The scanner module 17 determines the position of each of the four colour images on the receiving medium 20 and sends this data to the data controller 3. In a next step the receiving medium 20 is separated from the belt 11 indicated by arrow S by a separation unit for moving the receiving medium towards the inkjet print drying module 2.

The receiving medium is transferred to the inkjet print drying module 2. The inkjet print drying module 2 comprises belt 42, which is transported by an assembly of belt rollers 44 in a direction of R. The receiving medium 20 is attracted to the belt by means of a suction unit 46. The receiving medium 20 is dried by the heater device 48. The dried print product is made available on a tray 50 in the print storage module 5.

Figure 1B:
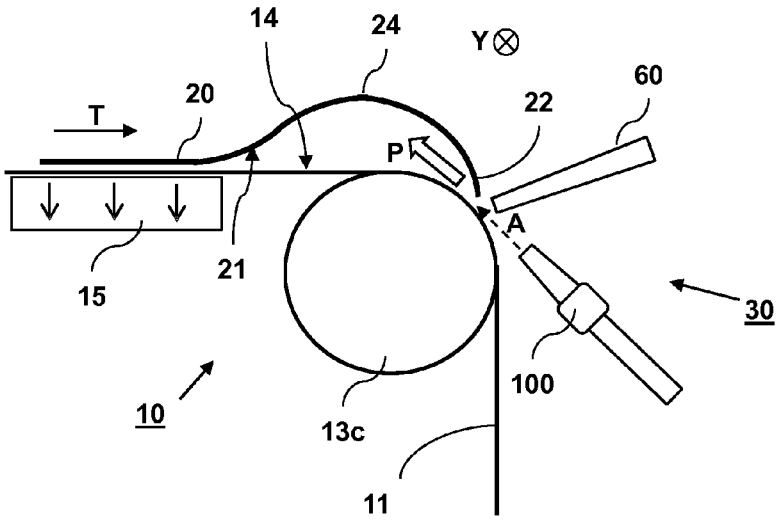
FIG. 1B PRIOR ART
FIG. 1B shows a separation unit of a prior art sheet transport assembly.

FIG. 1B shows an enlarged view of a separation unit of a prior art sheet transport assembly shown in FIG. 1A. The sheet transport assembly 10 comprises a transport belt 11, which is conveyed by rollers 13*a*-13*c* as shown in FIG. 1A. A sheet 20 is placed with a contact side 21 on a support surface of the transport belt 14 and advanced by the transport belt in a transport direction T by moving the transport belt in the transport direction T. The sheet transport assembly 10 further comprises a separation unit 30. The separation unit 30 comprises a leading edge blowing device 100, such as an air knife, and a sheet guidance element 60. Said air knife 100 is to an air supply source (not shown) and comprising a manifold 102 having an outlet 104 for directing a separation air flow A along the transport belt 11 adjacent to a circumferential surface of the deflection roller 13*c*. A leading edge of the sheet 22 arrives at the deflection roller 13*c* and travels in the transport direction T while at the same position the transport belt 11 is deflected away from the transport direction T by the rotating deflection roller 13*c*. At this position the separation air flow A is directed towards the leading edge 22 to lift the leading edge of the sheet 22 from the transport belt 11. In a next step the leading edge 22 engages the sheet guidance element 60, which is arranged facing the support surface of the transport belt 14 proximate to the deflection roller 13*c*.

However in case the sheet 20 has a curled portion 24, which is heavily curled downwards towards the transport belt 11 (as shown in FIG. 1B), the leading edge 22 is bend towards the support surface of the transport belt 14. Such a curling of the sheet may be prevented in an area where a suction unit 15 provides a suction pressure through holes of the transport belt 11 to the contact side of the sheet 21. However in the region of the transport belt downstream of the suction unit in the transport direction T where no suction pressure is applied to the contact side of the sheet 21 the curled portion 24 may develop and grow. A curled portion of the sheet may, depending on internal tension in the sheet, for example attain a diameter of about 23 mm or less. As a result the leading edge of the sheet 22 moves downwards at the deflection roller 13*c* together with the transport belt 11 and is insufficiently separated from the transport belt 11 at the deflection roller 13*c*. The separation air flow A provided by the leading edge blowing device 100 does not lift the leading edge from the transport belt 11, but pushes the leading edge 22 further backwards along the support surface of the transport belt 14 as indicated by arrow P. As a result a curl deformation of the curled portion 24 is further enhanced and the leading edge of the advancing sheet 20 is obstructed by the sheet guidance element 60. In this way the sheet 20 is urged to make an uncontrolled revolving movement with respect to the transport direction T.

Figure 2A:
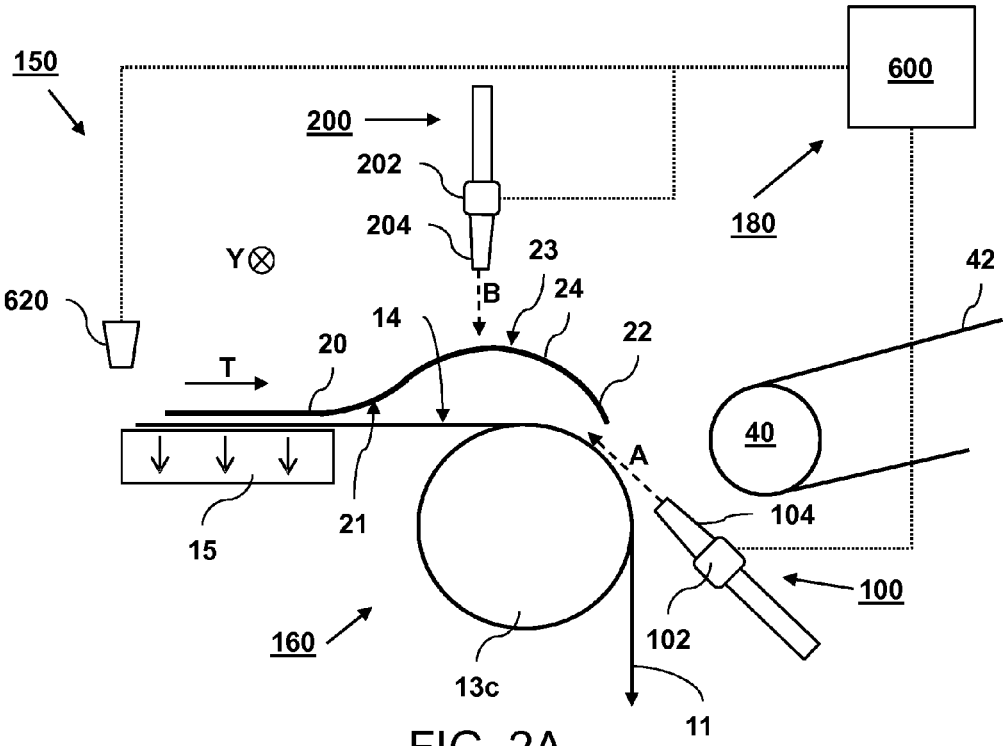
FIG. 2A-2C show an embodiment of the sheet transport assembly according to the present invention.
Figure 2B:
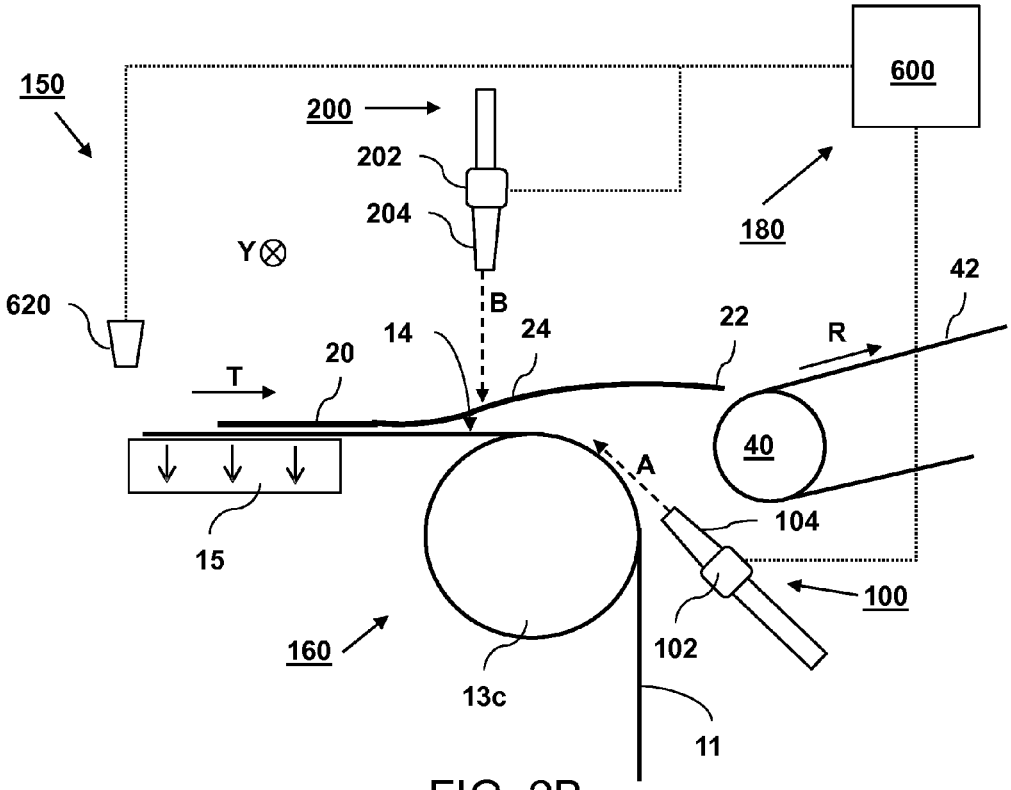
Figure 2C:
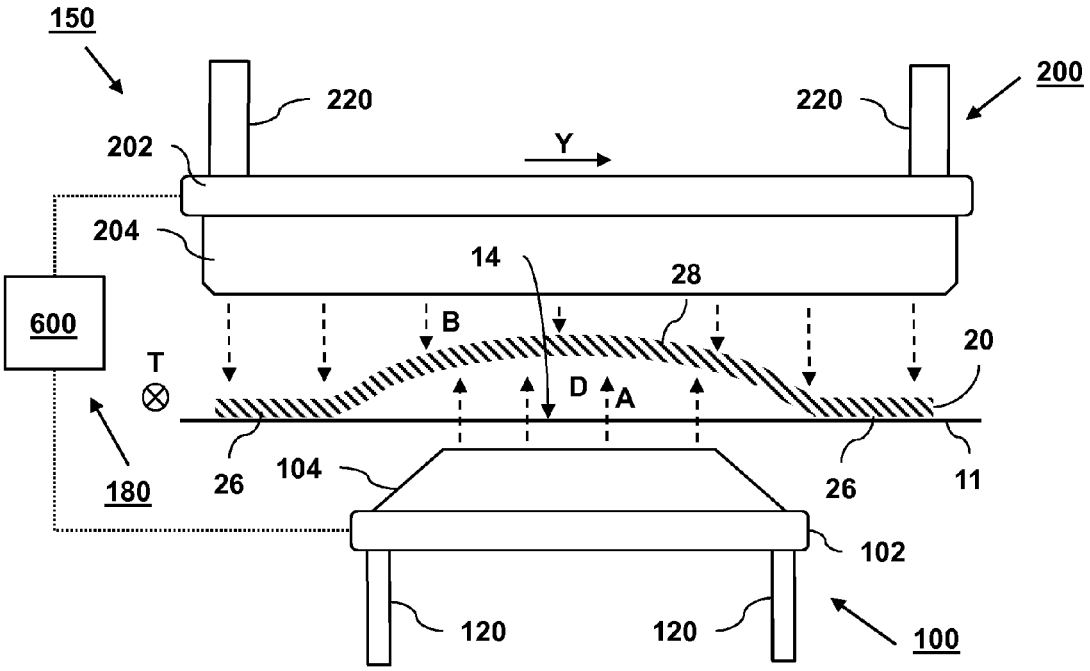

FIGS. 2A-2C show an embodiment of the sheet transport assembly according to the present invention. The sheet transport assembly 150 comprises a conveying unit 160 comprising a transport belt 11 and a plurality of deflection rollers 13*a*-13*c*, such as shown in FIG. 1A. In FIG. 2A shows an enlarged side view of the sheet transport assembly 150 showing the transport belt 11 and one of the deflection rollers 13*c* of the conveying unit 160.

A sheet 20 is placed with a contact side 21 on a support surface of the transport belt 14 and advanced by the transport belt 11 in a transport direction T by moving the transport belt in the transport direction T towards the deflection roller 13*c*. The sheet is attracted to the support surface of the transport belt 14 by a suction unit 15 which is arranged adjacent to the transport belt 11 for providing a suction pressure through holes of the transport belt 11 to the contact side of the sheet 21.

The sheet transport assembly 150 further comprises a separating unit 180 comprising a leading edge air knife 100, a restrain air knife 200, a separating control unit 600 and a sensor 620. Both the leading edge air knife 100 and the restrain air knife 200 are connected to an air supply source (not shown). The leading edge air knife 100 comprises a manifold 102 having an outlet 104 for directing a separation air flow A along the transport belt 11 adjacent to a circumferential surface of the deflection roller 13*c*. The restrain air knife 200 comprises a manifold 202 having an outlet 204 for directing a restrain air flow B onto a process side of the sheet 23 for urging the sheet 20 towards the transport belt 11. The outlet 204 is arranged to direct the restrain air flow B substantially perpendicular to the transport direction T, such as at an angle of 70-110 degrees with respect to the transport direction T. This arrangement optimizes the restraining force applied by the restrain air flow B onto the process side of the sheet 23. The restrain air knife 200 is arranged upstream of the leading edge air knife 100 in the transport direction T for applying said restrain air flow B onto the process side of the sheet 23 upstream in the transport direction T with respect to the leading edge air knife 100 applying the separation air flow A onto a leading edge of the sheet 22. The distance between the restrain air knife 200 applying the restrain air flow B and the leading edge air knife 100 applying the separation air flow A on the sheet 20 is in the range of 5 mm to 40 mm.

A leading edge of the sheet 22 arrives at the deflection roller 13 and travels in the transport direction T while at the same position the transport belt 11 is deflected away from the transport direction T by the rotating deflection roller 13*c*. At this position the separation air flow A is directed towards the leading edge 22 to lift the leading edge of the sheet 22 from the transport belt 11.

In FIG. 2A a first stage of a method of operating the separating unit 180 is shown, wherein a curled portion of the sheet 24 arrives at the restrain air knife 200. The leading edge of the sheet 22 has been detected upstream of the restrain air knife 200 by sensor 620. The sensor 620 is configured for detecting the leading edge of the sheet 22 and provides a timing signal to the separation control unit 600. The separation control unit 600 controls the leading edge air knife 100 and the restrain air knife 200. The separation control unit 600 controls the restrain air knife 200 for applying the restrain flow B onto a process side of the sheet 23 so that the curled portion of the sheet 24 is pushed towards the support surface of the transport belt 14 by the restrain flow B.

In FIG. 2B-2C a second stage of the method of operating the separating unit 180 is shown, wherein the leading edge of the sheet 22 arrives at position where the separation air flow A contacts the leading edge 22. A curled portion of the sheet 24 is pushed towards the transport belt by the restrain air knife 200. The separation control unit 600 controls the leading edge air knife 100 for applying the separation air flow A along the transport belt 11 to the leading edge 22 to lift the leading edge 22 away from the support surface of the transport belt 14.

After the second stage shown in FIG. 2B the separation control unit 600 controls the restrain air knife 200 to stop the restrain air flow B after the leading edge of the sheet 22 has fully been lifted along a middle portion of the width of the sheet 28 (shown in FIG. 2C) from the support surface of the transport belt 14 by the leading edge air knife 100. The leading edge 22 has passed the position where the separation air flow A contacts the sheet 20.

Figure 5A:
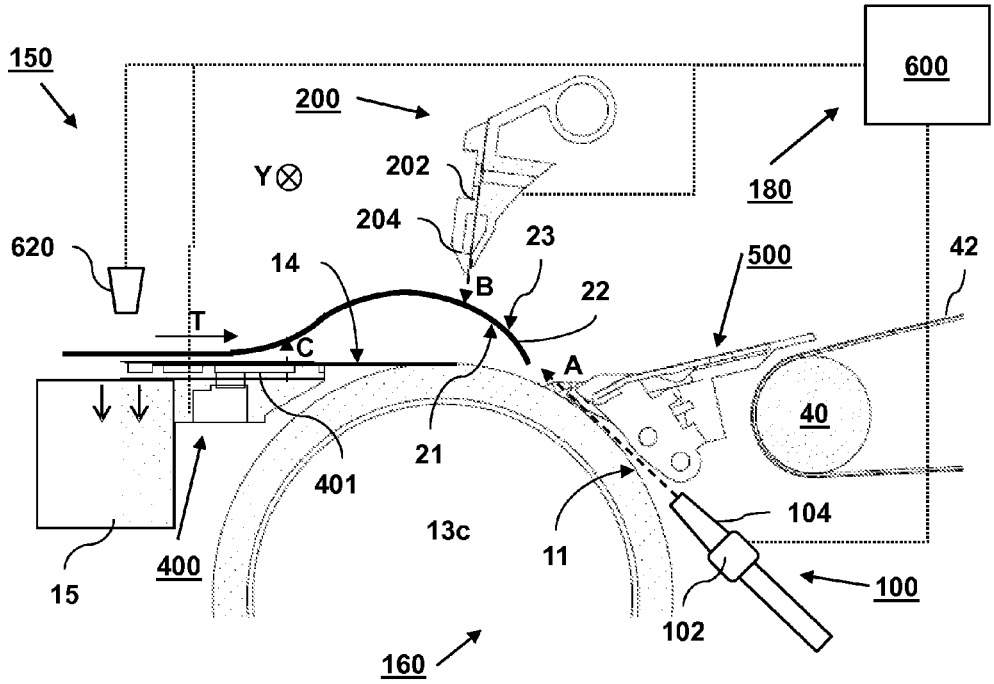
FIGS. 5A-5C show an embodiment of the sheet transport assembly according to the present invention.
Figure 5B:
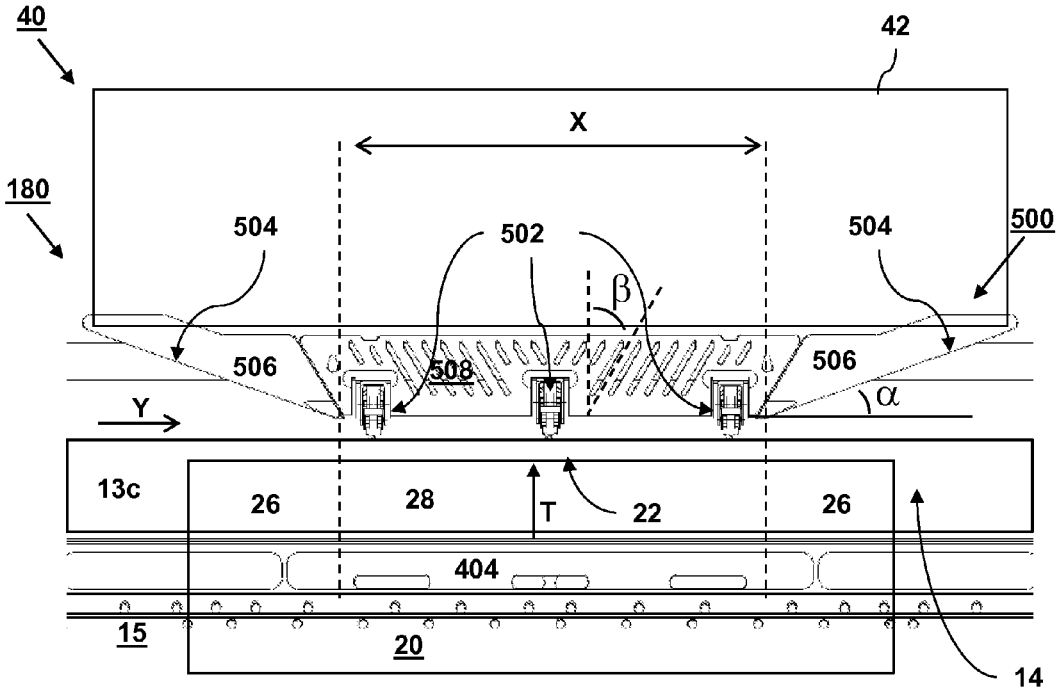

The separation control unit 600 controls the leading edge air knife 100 to maintain the separation air flow A until the leading edge 22 has reached a next transport element, such as a transport belt 42 shown in FIG. 1A or a guidance element 500 shown in FIG. 5B, downstream in the transport direction T. The transport belt 42 advances the sheet 20 further in the direction R.

In FIG. 2C a cross sectional view is shown of the embodiment of FIG. 2B perpendicular to the transport direction T along a lateral direction of the transport belt. In FIG. 2C the sheet 20 is shown being placed on the transport belt 11. A middle portion of the width of the sheet 28 is arranged on a middle section of the transport belt both with respect to the lateral direction Y. Furthermore the restrain air knife 200 and the leading edge air knife 100 is shown. The restrain air knife 200 comprises a manifold 202 having an outlet 204 extending over the transport belt 11 in the lateral direction Y for directing a restrain air flow B onto a process side of the sheet for urging the sheet 20 towards the transport belt 11. The air is provided to the restrain air knife 200 at both sides of the outlet 204 by air tubes 220 for providing the restrain air flow B substantially constant over the length of the outlet 204. In the embodiment shown the outlet 204 extends over a length of at least 300 mm in the lateral direction Y, being larger than a width of an A4 sheet (210 mm) or A3 sheet (297 mm). As such, the outlet 204 extends over the entire width of an A4 sheet or A3 sheet.

The leading edge air knife 100 comprises a manifold 102 having an outlet 104 extending only over a middle portion of the width of the sheet 28, the width being a dimension of the sheet perpendicular to the transport direction T, for directing a separation air flow A in a lifting area along a surface of the transport belt 11 onto the contact side of the sheet 21. The air is provided to the leading edge air knife 100 at both sides of the outlet 104 by air tubes 120 for providing the separation air flow A substantially constant over the length of the outlet 404.

As the outlet 104 of the leading edge air knife 100 extends only over the middle portion 28 and the outlet 204 of the restrain air knife 200 extends over the whole sheet in the width direction 26, 28 a pressure chamber D is provided between the sheet 20 and the transport belt 11, which pressure chamber D is enclosed by lateral side portions 26 of the sheet at both sides of the middle portion 28 in the lateral direction Y. In the embodiment shown the outlet 104 extends over a length of about 250 mm in the lateral direction Y, being smaller than a width of an A3 sheet (297 mm).

The separation air flow A detaches the sheet 20 from the transport belt and provides a positive pressure in a pressure chamber D between the sheet 20 and the support surface of the transport belt 14, which positive pressure lifts the sheet 20 including the leading edge 22 from the support surface of the transport belt 14 at the deflection roller 13*c* in the middle section of the sheet 28.

Figure 3A:
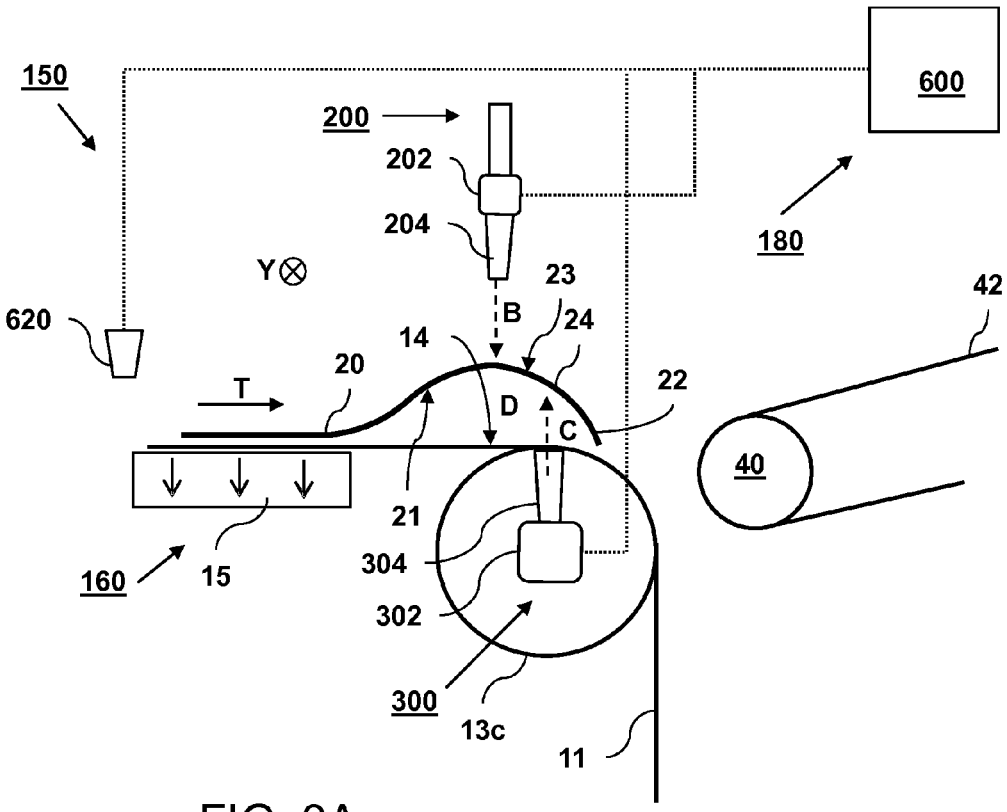
FIGS. 3A and 3B show an embodiment of the sheet transport assembly according to the present invention.
Figure 3B:
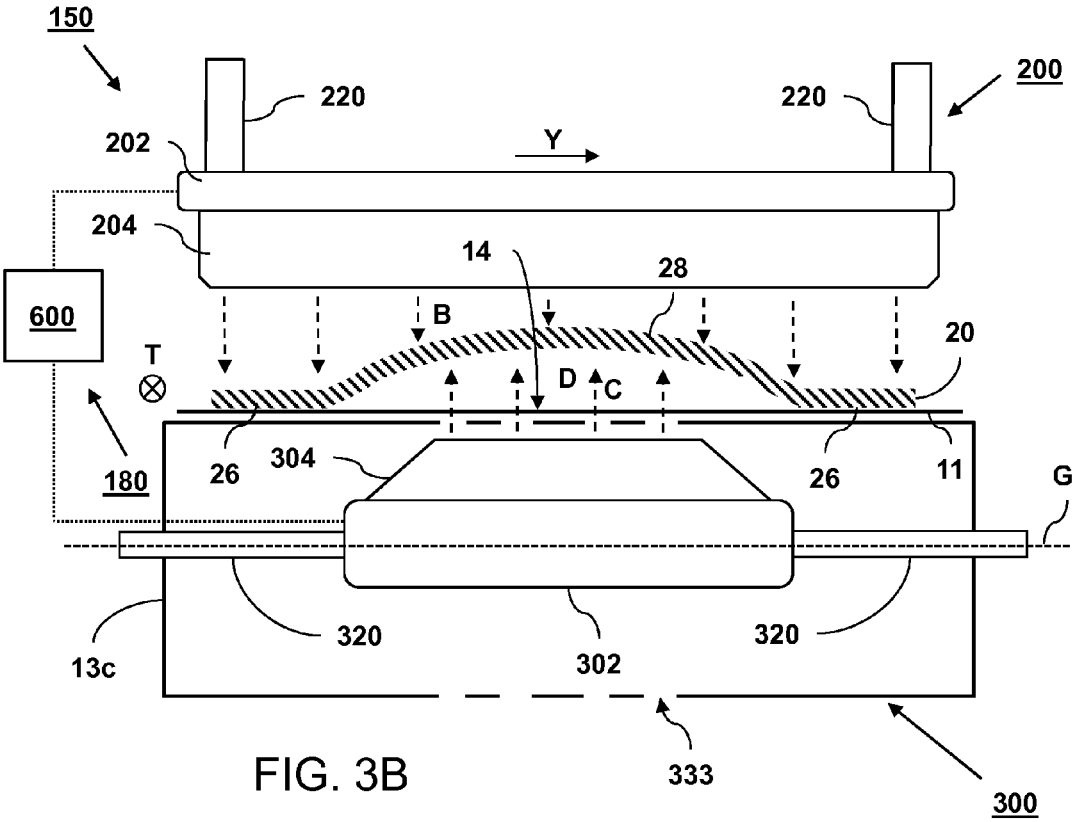

FIGS. 3A and 3B show an embodiment of the sheet transport assembly according to the present invention. The sheet transport assembly 150 comprises a conveying unit 160 comprising a transport belt 11 and a plurality of deflection rollers 13*a*-13*c*, such as shown in FIG. 1A. FIG. 3A shows an enlarged side view of the sheet transport assembly 150 showing the transport belt 11 and one of the deflection rollers 13*c* of the conveying unit 160.

A sheet 20 is placed with a contact side 21 on a support surface of the transport belt 14 and advanced by the transport belt in a transport direction T by moving the transport belt in the transport direction T towards the deflection roller 13*c*. The sheet is attracted to the support surface of the transport belt 14 by a suction unit 15 which is arranged adjacent to the transport belt 11 for providing a suction pressure through holes of the transport belt 11 to the contact side of the sheet 21.

The sheet transport assembly 150 further comprises a separating unit 180 comprising a restrain air knife 200, a detach blowing device 300, a sensor 620 and a separating control unit 600. Both blowing devices 200, 300 are connected to an air supply source (not shown). The separating control unit 600 controls the operation of the blowing device 200, 300.

The restrain air knife 200 comprises a manifold 202 having an outlet 204 for directing a restrain air flow B onto a process side of the sheet 23 for urging the sheet 22 towards the transport belt 11. The detach blowing device 300 comprises a manifold 302 having an outlet 304 arranged for directing a detach air flow C in a lifting area through air permeable openings or holes of the deflection roller 13*c* and of the transport belt 11 onto the contact side of the sheet 21. The manifold 302 is arranged inside the deflection roller 13*c*. The outlet 304 is arranged inside the deflection roller 13*c* and being held stationary oriented towards the transport belt 11.

The detach manifold 302 is arranged proximate to the restrain air knife 200 in the transport direction T for applying said detach air flow C onto the contact side of the sheet 21 in the transport direction T proximate to the restrain air knife 200 applying the restrain air flow B onto the process side of the sheet 23. Preferably, the detach outlet 304 is arranged in a direction being substantially opposite to the outlet direction of the restrain outlet 204.

The suction unit 15 is arranged for retaining the sheet 20 onto the support surface of the transport belt 14. The suction unit 15 prevents that a sheet 20 is completely lifted from the transport belt 11 in case the detach air knife 400 is operated to apply the detach air flow C. In case the sheet 20 is completely lifted from the transport belt 11 control over the transport direction of the advancing sheet 20 may be lost.

In FIG. 3A a first stage of a method of operating the separating unit 180 is shown, wherein a downward curled portion of the sheet 24 arrives at the restrain air knife 200. The leading edge of the sheet 22 has been detected upstream of the restrain air knife 200 by sensor 620. The sensor 620 is configured for detecting the leading edge of the sheet 22 and provides a timing signal to the separation control unit 600. The separation control unit 600 controls the restrain air knife 200 for applying the restrain flow B onto a process side of the sheet 23 so that the downward curled portion of the sheet 24 is pushed towards the support surface of the transport belt 14 by the restrain flow B.

In FIG. 3B a cross sectional view is shown of the embodiment of FIG. 3A perpendicular to the transport direction T along a lateral direction of the transport belt. In FIG. 3B the sheet 20 is shown being placed on the transport belt 11. A middle portion of the width of the sheet 28 is arranged on a middle section of the transport belt both with respect to the lateral direction Y. Furthermore the restrain air knife 200 and the detach blowing device 300 are shown. The restrain air knife 200 comprises a manifold 202 having an outlet 204 extending over the transport belt 11 in the lateral direction Y for directing a restrain air flow B onto a process side of the sheet for urging the sheet 20 towards the transport belt 11. The air is provided to the restrain air knife 200 at both sides of the outlet 204 by air tubes 220 for providing the restrain air flow B substantially constant over the length of the outlet 204. In the embodiment shown the outlet 204 extends over a length of at least 300 mm in the lateral direction Y, being larger than a width of an A4 sheet (210 mm) or A3 sheet (297 mm). As such, the outlet 204 extends over the entire width of an A4 sheet or A3 sheet.

The detach blowing device 300 comprises a manifold 302 having an outlet 304 extending only over a middle portion of the width of the sheet 28, the width being a dimension of the sheet perpendicular to the transport direction T, for directing a detach air flow C in a lifting area through the transport belt 14 onto the contact side of the sheet 21. The deflection roller 13*c* comprises a plurality of elongated holes 333 extending along a circumferential direction of the deflection roller 13*c*, i.e. extending around the main axis of rotation G of the deflection roller 13*c*. The plurality of elongated holes 133 are air permeable openings, which are arranged for communicating the detach air flow C from inside the deflection roller 13*c* through the air permeable openings of the transport belt 14 onto the contact side of the sheet 21 in the lifting area.

The air is provided to the detach manifold 302 at both sides of the outlet 304 by air tubes 320 for providing the detach air flow C substantially constant over the length of the outlet 304. The manifold 302 and the outlet 304 are held stationary with respect to the main axis of rotation G of the deflection roller 13*c*.

As the outlet 304 of the detach blowing device 300 extends only over the middle portion 28 and the outlet 204 of the restrain air knife 200 extends over the whole sheet in the width direction 26, 28 a pressure chamber D is provided between the sheet 20 and the transport belt 11, which pressure chamber D is enclosed by lateral side portions 26 of the sheet at both sides of the middle portion 28 in the lateral direction Y. In the embodiment shown the outlet 304 extends over a length of about 250 mm in the lateral direction Y, being smaller than a width of an A3 sheet (297 mm).

The detach air flow C detaches the sheet 20 from the transport belt and provides a positive pressure in a pressure chamber D between the sheet 20 and the support surface of the transport belt 14, which positive pressure lifts the sheet 20 including the leading edge 22 from the support surface of the transport belt 14 at the deflection roller 13*c* in the middle section of the sheet 28.

Figure 4A:
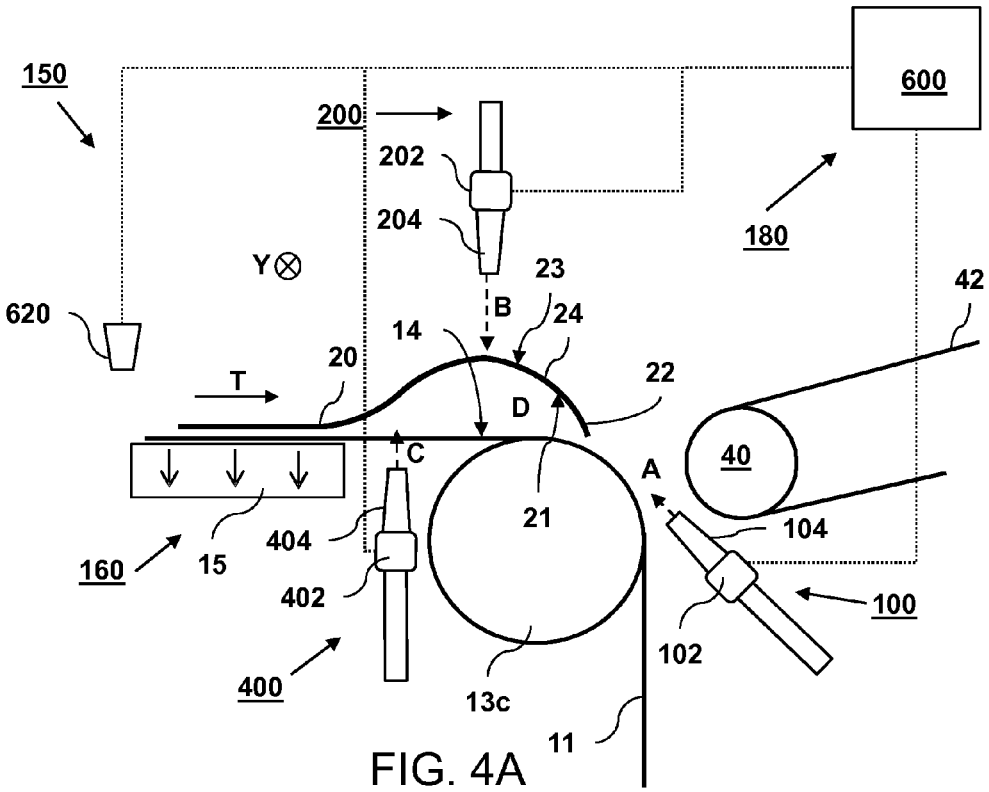
FIGS. 4A-4C show an embodiment of the sheet transport assembly according to the present invention.
Figure 4B:
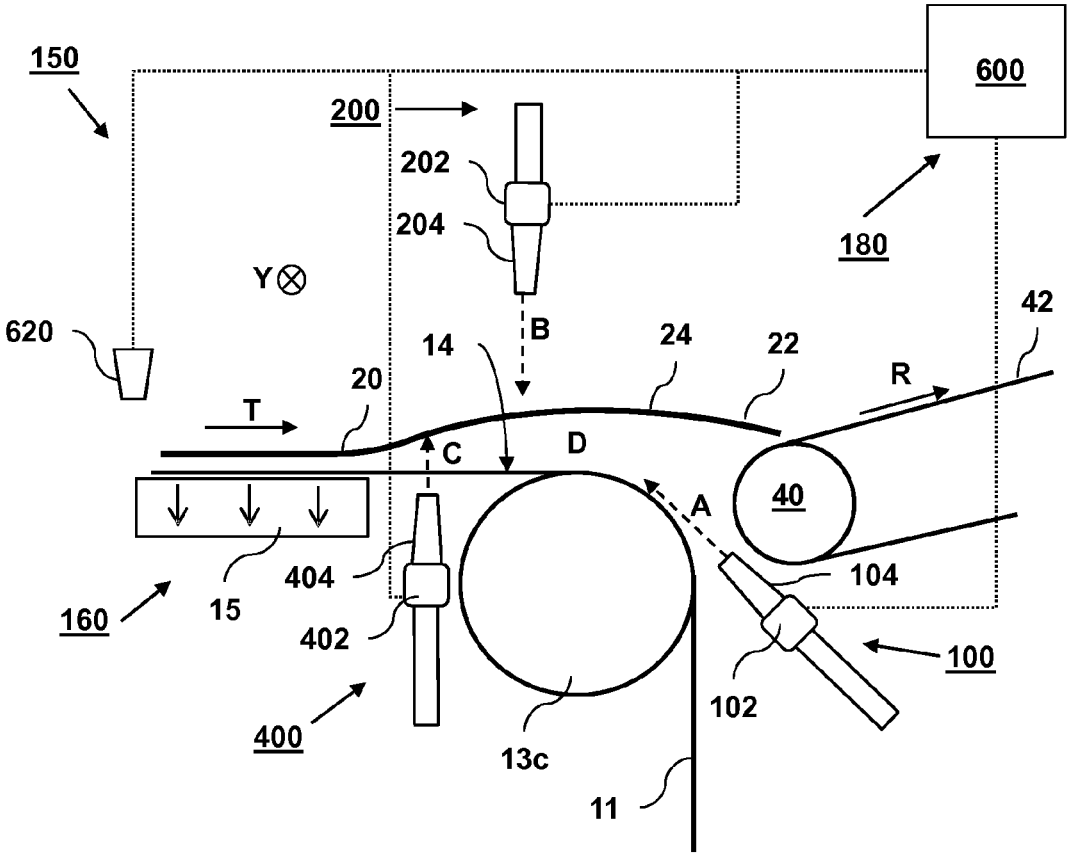

FIGS. 4A and 4B show an embodiment of the sheet transport assembly according to the present invention. The sheet transport assembly 150 comprises a conveying unit 160 comprising a transport belt 11 and a plurality of deflection rollers 13*a*-13*c*, such as shown in FIG. 1A. FIG. 4A shows an enlarged side view of the sheet transport assembly 150 showing the transport belt 11 and one of the deflection rollers 13*c* of the conveying unit 160.

A sheet 20 is placed with a contact side 21 on a support surface of the transport belt 14 and advanced by the transport belt in a transport direction T by moving the transport belt in the transport direction T towards the deflection roller 13*c*. The sheet is attracted to the support surface of the transport belt 14 by a suction unit 15 which is arranged adjacent to the transport belt 11 for providing a suction pressure through holes of the transport belt 11 to the contact side of the sheet 21.

The sheet transport assembly 150 further comprises a separating unit 180 comprising a leading edge air knife 100, a restrain air knife 200, a detach air knife 400, a sensor 620 and a separating control unit 600. All three air knifes 100, 200, 400 are connected to an air supply source (not shown). The separating control unit 600 controls the operation of the air knifes 100, 200, 400.

The leading edge air knife 100 comprises a manifold 102 having an outlet 104 for directing a separation air flow A in a second lifting area $L_2$ along the surface of transport belt 11 adjacent to a circumferential surface of the deflection roller 13*c*. The restrain air knife 200 comprises a manifold 202 having an outlet 204 for directing a restrain air flow B onto a process side of the sheet 23 for urging the sheet 22 towards the transport belt 11. The detach air knife 400 comprises a manifold 402 having an outlet 404 arranged for directing a detach air flow C through air permeable openings or holes of the transport belt 11 onto the contact side of the sheet 21. The outlet 404 is arranged adjacent to the transport belt 11 proximate to the deflection roller 13*c* downstream of the suction unit 15 in the transport direction T.

The detach air knife 400 is arranged upstream of the restrain air knife 200 and the leading edge air knife 100 in the transport direction T for applying said detach air flow C in a first lifting area $L_1$ onto the contact side of the sheet 21 upstream in the transport direction T with respect to the restrain air knife 200 applying the restrain air flow B in a restrain area U onto the process side of the sheet 23. The distance between the detach air knife 400 applying the detach air flow C in the first lifting area $L_1$ and the leading edge air knife 100 applying the separation air flow A in the second lifting area $L_2$ on the sheet 20 is in the range of 20 mm-100 mm.

The detach air knife 400 may alternatively be provided by a blowing unit (not shown), which is attached to the suction unit 15, and which provides a detach air flow C through air permeable openings or holes of the transport belt 11 onto the contact side of the sheet 21 downstream of the suction unit 15 in the transport direction T.

The suction unit 15 is arranged adjacent to the detach air knife 400 for retaining the sheet 20 onto the support surface of the transport belt 14. The suction unit 15 prevents that a sheet 20 is completely lifted from the transport belt 11 in case both the detach air knife 400 and the leading edge air knife 100 are operated to apply the separation air flow A and the detach air flow C at the same time. In case the sheet 20 is completely lifted from the transport belt 11 control over the transport direction of the advancing sheet 20 may be lost.

In FIG. 4A a first stage of a method of operating the separating unit 180 is shown, wherein a downward curled portion of the sheet 24 arrives at the restrain air knife 200. The leading edge of the sheet 22 has been detected upstream of the restrain air knife 200 by sensor 620. The sensor 620 is configured for detecting the leading edge of the sheet 22 and provides a timing signal to the separation control unit 600. The separation control unit 600 controls the restrain air knife 200 for applying the restrain flow B onto a process side of the sheet 23 so that the downward curled portion of the sheet 24 is pushed towards the support surface of the transport belt 14 by the restrain flow B.

In FIG. 4B a second stage of the method of operating the separating unit 180 is shown, wherein the leading edge of the sheet 22 has arrived at a position where the separation air flow A may contact the leading edge 22.

The separation control unit 600 controls the leading edge air knife 100 for applying the separation air flow A along the transport belt 11 to the leading edge 22 to lift the leading edge 22 away from the support surface of the transport belt 14. At substantially the same time the separation control unit 600 controls the detach air knife 400 for applying the detach air flow C onto the contact side of the sheet 21. The detach air flow C detaches the sheet 20 from the transport belt and in cooperation with the separation air flow A provides a positive pressure in a pressure chamber D between the sheet 20 and the support surface of the transport belt 14, which positive pressure lifts the sheet 20 including the leading edge 22 from the support surface of the transport belt 14 at the deflection roller 13*c*. The leading edge 22 is transferred to a next transport element 40, such as a transport belt 42 shown in FIG. 1A, downstream in the transport direction T. The transport belt 42 advances the sheet 20 further in the direction R.

In this embodiment, at least one of the first lifting area $L_1$ of the detach air knife 400 and the second lifting area $L_2$ of the leading edge air knife 100 is arranged extending only over a middle portion of the width of the sheet 20, the width being a dimension of the sheet 20 in a lateral direction Y perpendicular to the transport direction T.

Figure 4C:
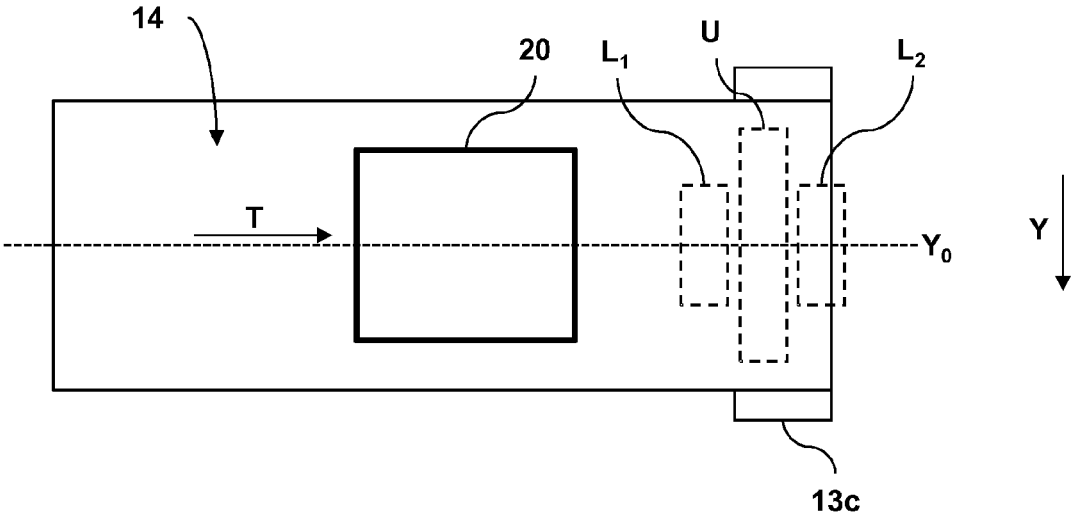

FIG. 4C shows a plane view of the transport belt 14 in the transport direction T towards the deflection roller 13*c*. Preferably both the first lifting area $L_1$ and the second lifting area $L_2$ are arranged extending only over a middle portion of the width of the sheet, as is shown in FIG. 4C. The first lifting area $L_1$ and the second lifting area $L_2$ are aligned to one another relative to a centre position $Y_0$ of the transport belt 14 in the lateral direction Y.

The restrain area U is arranged extending substantially over an entire width of the sheet 20 in the lateral direction Y. In this way, the restrain air flow B urges lateral side portions of the sheet 20 towards the transport belt 14, which lateral side portions are arranged at both sides of the middle portion along the width of the sheet 20. As a result, an air pressure chamber is formed between the sheet and the transport belt 14 extending over the middle portion of the sheet 20 between both lateral side portions of the sheet 20. In this way, the lifting air flow provided by the detach blowing device 400 and the leading edge blowing device 100 are better able to lift the middle portion of the sheet 20 from the transport belt 14 even in case of a sheet 20 having a tendency to curl towards the transport belt 14.

The first lifting area $L_1$, the second lifting area $L_2$ and the restrain area U may have at least in part have an overlap of one another in the transport direction T. A distance between the first lifting area $L_1$ and the second lifting area $L_2$ in the transport direction T is suitably selected in order to optimize the formation of an air pressure chamber along the middle portion of the width of the sheet 20 between the lateral side portions of the sheet 20.

Figure 5C:
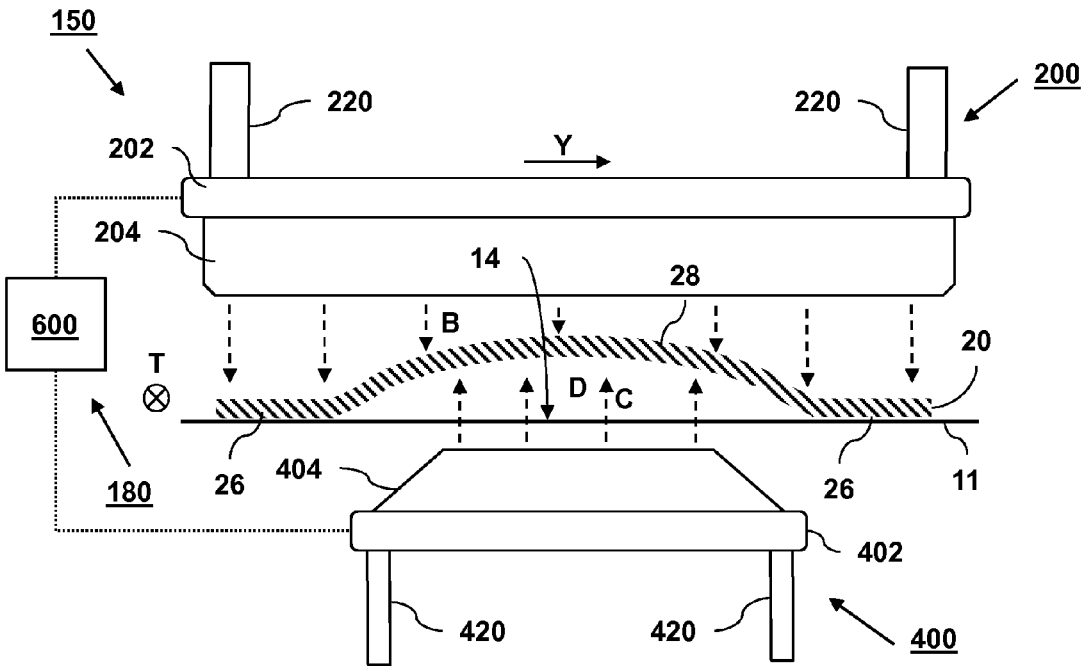

FIGS. 5A-5C show an embodiment of the sheet transport assembly according to the present invention. The sheet transport assembly 150 comprises a conveying unit 160 comprising a transport belt 11 and a plurality of deflection rollers 13*a*-13*c*, such as shown in FIG. 1A.

FIG. 5A shows an enlarged side view of the sheet transport assembly 150 showing the transport belt 11 and one of the deflection rollers 13*c* of the conveying unit 160. A sheet 20 is placed with a contact side 21 on a support surface of the transport belt 14 and advanced by the transport belt 11 in a transport direction T by moving the transport belt 11 in the transport direction T towards the deflection roller 13*c*. The sheet is attracted to the support surface of the transport belt 14 by a suction unit 15 which is arranged adjacent to the transport belt 11 for providing a suction pressure through holes of the transport belt 11 to the contact side of the sheet 21.

The sheet transport assembly 150 further comprises a separating unit 180 comprising a leading edge air knife 100, a restrain air knife 200, a detach air knife 400, a sheet guidance element 500, a sensor 620 and a separating control unit 600. All three air knifes 100, 200, 400 are connected to an air supply source (not shown). The separating control unit 600 controls the operation of the air knifes 100, 200, 400.

The leading edge air knife 100, a restrain air knife 200, a detach air knife 400 are arranged along the conveying unit 160 in the transport direction T similar to the embodiment shown in FIGS. 4A-4B.

The detach air knife 400 is provided by a blowing unit 401, which may be attached to the suction unit 15, and which provides a detach air flow C through air permeable openings or holes of the transport belt 11 onto the contact side of the sheet 21 downstream of the suction unit 15 in the transport direction T.

FIG. 5B shows a plane view of the sheet transport assembly 150 at the separating unit 180. The sheet guidance element 500 is arranged facing the support surface of the transport belt 14 proximate to the deflection roller 13*c*. As shown in FIG. 5B the sheet guidance element 500 comprises separation needles 502, guidance edges 504 and a guidance surface 506 which comprises openings 508. The separation needles 502 are arranged protruding from the guidance surface 506 of the sheet guidance element 500 close to the support surface of the transport belt 14 and are configured for lifting the leading edge of the sheet 22 away from the transport belt 11. The separation needles 502 may be arranged contacting the support surface of the sheet transport belt 14 or may be arranged at a close distance, such as about 0.1-0.3 mm. The separation needles 502 are distributed over a middle section of the transport belt 11 in a lateral direction Y, which is perpendicular to the transport direction T. The separation needles 502 comprise support surfaces (not shown) arranged for guiding the contact side of the sheet 21 towards the guidance surface 506 of the sheet guidance element 500.

The leading edge air knife 100 comprises a manifold 102 having an outlet 104 extending at least over a distributed width X of the separation needles 502 in the lateral direction Y for directing a separation air flow A along the transport belt 11 adjacent to a circumferential surface of the deflection roller 13*c*. In the embodiment shown the outlet 104 extends over a length of at least 300 mm in the lateral direction Y, being larger than a width of an A4 sheet (210 mm) or A3 sheet (297 mm). The leading edge air knife 100 is arranged at a distance from the sheet guidance element 500 for lifting a leading edge 22 of the sheet from the middle section of the transport belt 11 at the separation needles 502 of the sheet guidance element 500.

In case the leading edge air knife 100 is arranged too close to the sheet guidance element 500 a vortex may be formed between the transport belt 11 and the sheet guidance element 500, which vortex may pull down the leading edge of the sheet 22.

The guidance edges 504 are arranged at the sides of the distributed separation needles 502 in the lateral direction Y. Each guidance edge 504 is arranged at an acute angle α with respect to the lateral direction Y, wherein said angle α is about 10-30 degrees. The guidance edges 504 are arranged for guiding the leading edge 22 and side edges of the sheet 20 onto the guidance surface of the sheet guidance element 506. The guidance edges 504 preferably have friction reducing portions, such as having an average surface roughness Ra below 0.2 micron (determined according to ISO 4287-1997).

In case corners of the sheet 20 at the leading edge 22 are curled downwards towards the transport belt 11, the guidance edges 504 guide the leading edge 22 and the corners of the sheet 20 onto the guidance surface of the sheet guidance element 506. As the leading edge 22 is guided by the guidance edges 504 the restrain air flow B is still applied onto a process side of the sheet 23 so that the downward curled portion of the sheet 24 is pushed towards the support surface of the transport belt 14 by the restrain flow B. As a result the stiffness of the sheet at the leading edge 22 is increased, such that the restrain air flow B supports guiding the leading edge 22 and corners, which are curled downwards, onto the guidance surface of the sheet guidance element 506.

The guidance surface 506 is arranged for supporting the contact side of the sheet 21 during further transport of the sheet 20 towards a next transport element 40, such as another transport belt. The guidance surface 506 is arranged substantially parallel to the transport direction T. Alternatively the guidance surface 506 may be arranged at a small angle with respect to the transport direction T for further lifting the sheet 20 from the transport belt 11 upwards in the direction of the process side of the sheet 23. The guidance surface 506 extends in part over a next transport element 40, such as a transport belt 42 which is advanced by roller 44 of a drying unit 2 as is shown in FIG. 1A.

The guidance surface 506 comprises a plurality of openings 508, which have the shape of slots and which extend in a direction having an angle β with the transport direction T. The plurality of openings 508 are arranged for removing any air pressure build-up between a sheet 20 and the guidance surface 506. The angle β is selected for guiding the edges of the sheet 20 over the guidance surface 506.

In FIG. 5C a cross sectional view is shown of the embodiment of FIG. 5A perpendicular to the transport direction T. In FIG. 5C the sheet 20 is shown being placed on the transport belt 11. A middle portion of the sheet 28 is arranged on a middle section of the transport belt both with respect to the lateral direction Y. Furthermore the restrain air knife 200 and the detach air knife 400 is shown. The restrain air knife 200 comprises a manifold 202 having an outlet 204 extending over the transport belt 11 in the lateral direction Y for directing a restrain air flow B onto a process side of the sheet for urging the sheet 20 towards the transport belt 11. The air is provided to the restrain air knife 200 at both sides of the outlet 204 by air tubes 220 for providing the restrain air flow B substantially constant over the length of the outlet 204. In the embodiment shown the outlet 204 extends over a length of at least 300 mm in the lateral direction Y, being larger than a width of an A4 sheet (210 mm) or A3 sheet (297 mm).

The detach air knife 400 comprises a manifold 402 having an outlet 404 extending over a middle portion of a width of the sheet 28, the width being perpendicular to the transport direction T for directing a detach air flow C through air permeable openings of the transport belt 11 onto the contact side of the sheet 21. The air is provided to the detach air knife 400 at both sides of the outlet 404 by air tubes 420 for providing the detach air flow C substantially constant over the length of the outlet 404.

As the outlet 404 of the detach air knife 400 extends over the middle portion 28 and the outlet 204 of the restrain air knife 200 extends over the whole sheet in the width direction 26, 28 a pressure chamber D is provided between the sheet 20 and the transport belt 11, which pressure chamber D is enclosed by lateral side portions 26 of the sheet at both sides of the middle portion 28 in the lateral direction Y. In the embodiment shown the outlet 404 extends over a length of about 250 mm in the lateral direction Y, being smaller than a width of an A3 sheet (297 mm).

The detach air flow C detaches the sheet 20 from the transport belt and in cooperation with the separation air flow A (shown in FIGS. 4A-4B) provides a positive pressure in a pressure chamber D between the sheet 20 and the support surface of the transport belt 14, which positive pressure lifts the sheet 20 including the leading edge 22 from the support surface of the transport belt 14 at the deflection roller 13*c* in the middle section of the sheet 28.

The leading edge 22 at the middle portion 28 is guided by the separation needles 502 towards the guidance surface 506. The leading edge 22 at the lateral portions 26 is guided by the guidance edges 504 towards the guidance surface 506. In this embodiment less air flow is needed in a shorter time from both the leading edge air knife 100 and the detach air knife 400, which also leads to a more controlled lifting and guiding of the sheet towards a next transport element 40, such as another transport belt.

Control of Air Flows

Figure 6:
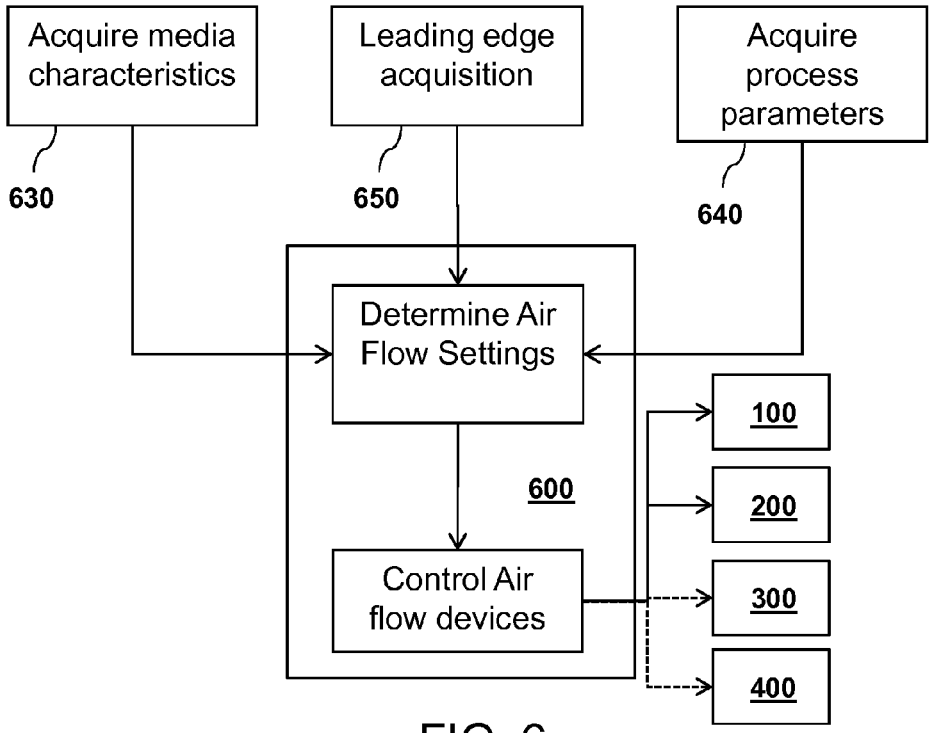
FIG. 6 shows a block diagram illustrating control of air flow settings by the separating control unit.

In the embodiments shown in FIGS. 2A-5C the respective air knifes 100, 200, 300 and/or 400 are controlled by the separating control unit 600. The separating control unit 600 controls the air flows, as shown in block diagram FIG. 6, provided by each air knife 100, 200, 300 and/or 400 in respect of air flow settings, such as air flow pressure [bar], air flow volume [l/min], air flow speed [m/s] and air flow timing [ms]. The air flow pressure is controlled in the range of 0-5 bar. The air flow volume is controlled in the range of 0-200 l/min per air flow knife. The air flow volume depends on the air flow restrictions of the respective air knifes and on the air flow pressure. The air flow speed is controlled in the range of 0-50 m/s and also depends on the air flow restrictions of the respective air knifes and on the air flow pressure.

The air flow timing of the respective air knifes 100, 200, 300 and/or 400 is important for the functioning of the separating unit 180. The separating control unit 600 determines the air flow timing [ms] of the respective air knifes 100, 200, 300 and/or 400 based on media characteristics 630 of the sheet 20 and/or based on process parameters 640 of the sheet 20, such as advancing speed of the transport belt 11 in the transport direction T and such as ink coverage of the sheet 20 based on print data and droplet sizes used. Furthermore the separating control unit 600 determines a starting timing [ms] of the air flow timing in response to receiving a leading edge acquisition 650 from the sensor 620.

Examples of media characteristics 630 are heavy coated media, plain paper, coated offset paper, grammage of the media (e.g. in g/m2), or any other relevant media characteristics 630 which are related to curl behavior of the sheet 20 due to internal tension in the sheet in response to a process unit. The separating control unit 600 comprises or is connected to a database comprising media characteristics 630 which are related to optimal air flow settings.

EXAMPLES

A few examples of air flow settings of specific media characteristics are shown in Table 1. Table 1 is related to the embodiment shown in FIGS. 4A and 4B comprising the restrain air knife 200, the detach air knife 400 and the leading edge air knife 100.

TABLE 1 air flow settings based on media characteristics of two different plain papers

| Example | Media characteristic | Restrain air flow | Detach air flow | Leading edge air flow |
|---|---|---|---|---|
| 1 | plain paper, 80 gsm | start timing: 50 ms<br>duration: 80 ms<br>flow velocity: 50 m/s | start timing: 70 ms<br>duration: 20 ms<br>flow: 2 liter/s | start timing: 70 ms<br>duration: 20 ms<br>flow velocity: 20 m/s |
| 2 | plain paper, 60 gsm | start timing: 50 ms<br>duration: 60 ms<br>flow velocity: 50 m/s | start timing: 70 ms<br>duration: 20 ms<br>flow: 1 liter/s | start timing: 70 ms<br>duration: 20 ms<br>flow velocity: 15 m/s |

The air flow settings concerning timing aspects are related to an advancing speed of 1000 mm/s of the sheet in the transport direction. In case of other advancing sheet the separating control unit 600 may accordingly adjust the timing aspects of the air flow. The detach air flow is measured in flow volume per time, while the restrain air flow and the leading edge air flow are measured in air flow velocity.

In case the restrain air flow setting is too high the sheet is pushed too much onto the support surface of the transport belt and the sheet is not lifted sufficiently by the detach air flow and the leading edge air flow.

In case the leading edge air flow is too high and/or too long the sheet as a whole is lifted too much during separation and is not controllably transported with respect to the transport direction T to a next transport element, such as the transport belt 42 of the drying module 2.

In case the detach air flow is too late and/or too small with respect to the leading edge air flow the air pressure in the pressure chamber D is not sufficient for lifting sheets independently of a curl level and/or a stiffness of the sheet.

In case the detach air flow is too high or too early with respect to the leading edge air flow the leading edge of the sheet may be forced towards the transport belt instead of lifted away from the transport belt.

Detailed embodiments of the present invention are disclosed herein; however, it is to be understood that the disclosed embodiments are merely exemplary of the present invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Further, the terms and phrases used herein are not intended to be limiting; but rather, to provide an understandable description of the present invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A sheet transport assembly for transporting a sheet along a process unit configured for applying a process to the sheet, the sheet transport assembly comprising:

a conveying unit comprising a transport belt and a deflection element, the transport belt being configured for advancing the sheet in a transport direction along the process unit to the deflection element, the sheet being placed with a contact side on the belt and a process side towards the process unit, the deflection element being arranged in contact with the transport belt to deflect the transport belt downstream in the transport direction relative to the process unit;

a separating unit for separating the sheet from the transport belt, the separating unit being connected to an air supply source and comprising a restrain blowing device arranged for directing a restrain air flow onto the process side of the sheet in a restrain area for urging the sheet towards the transport belt proximate to the deflection element, which is arranged for separating the sheet from the transport belt, and comprising a lifting blowing device arranged for directing a lifting air flow onto the contact side of the sheet in a lifting area for lifting the sheet from the transport belt, wherein said lifting area is arranged extending only over a middle portion of a width of the sheet, the width being a dimension of the sheet in a lateral direction perpendicular to the transport direction.

2. The sheet transport assembly according to claim 1, wherein said lifting blowing device is a leading edge blowing device arranged for directing a separation air flow along a surface of the transport belt in a direction along the deflected belt at the deflection element towards the leading edge of the sheet for lifting a leading edge of the sheet from the transport belt.

3. The sheet transport assembly according to claim 2, wherein said separating unit further comprises a detach blowing device arranged for directing a detach air flow through air permeable openings of the transport belt onto the contact side of the sheet proximate to the deflection element in a second lifting area for detaching the sheet from the transport belt, wherein optionally said second lifting area is arranged extending only over a middle portion of the width of the sheet.

4. The sheet transport assembly according to claim 3, wherein the detach blowing device is arranged to apply said detach air flow onto the contact side of the sheet upstream in the transport direction with respect to the restrain blowing device applying said restrain air flow onto the process side of the sheet.

5. The sheet transport assembly according to claim 1, wherein said lifting blowing device is a detach blowing device arranged for directing a detach air flow through air permeable openings of the transport belt proximate to the deflection element for detaching the sheet from the transport belt.

6. The sheet transport assembly according to claim 5, wherein said separating unit further comprises a leading edge blowing device arranged for directing a separation air flow along a surface of the transport belt in a direction along the deflected belt at the deflection element towards the leading edge of the sheet in a second lifting area for lifting a leading edge of the sheet from the transport belt, wherein optionally said second lifting area is arranged extending only over a middle portion of the width of the sheet.

7. The sheet transport assembly according to claim 5, wherein the detach blowing device is arranged to apply said detach air flow onto the contact side of the sheet upstream in the transport direction with respect to the restrain blowing device applying said restrain air flow onto the process side of the sheet.

8. The sheet transport assembly according to claim 1, wherein the restrain area is arranged at least extending adjacent to both sides of the lifting area in the lateral direction.

9. The sheet transport assembly according to claim 1, wherein the separating unit further comprises a sheet guidance element arranged facing the transport belt adjacent to the deflection element to guide the leading edge of the sheet away from the transport belt.

10. An inkjet printing apparatus comprising:

the sheet transport assembly according to claim 1; and said process unit, wherein the process unit is a printing station comprising a print head assembly configured for providing ink drops on the process side of the sheet, which sheet is arranged on the transport belt.

11. A method for transporting a sheet on a conveying unit along a process unit, the conveying unit comprising a transport belt and a deflection element arranged in contact with the transport belt to deflect the transport belt, the method comprising the steps of:

a) arranging a sheet on the transport belt, wherein the sheet is placed with a contact side on the transport belt and a process side towards the process unit;

b) advancing the sheet on the transport belt in a transport direction along the process unit to the deflection element to apply a process to the process side of the sheet, which process causes internal tension in the sheet; and c) separating the sheet from the transport belt, comprising moving the sheet on the transport belt along the deflection element, applying a restrain air flow onto the process side of the sheet in a restrain area for urging the sheet towards the transport belt proximate to the deflection element, which is arranged for separating the sheet from the transport belt, and applying a lifting air flow onto the contact side of the sheet in a lifting area for lifting the sheet from the transport belt, wherein said lifting area is arranged extending only over a middle portion of a width of the sheet, the width being a dimension of the sheet in a lateral direction perpendicular to the transport direction.

12. The method according to claim 11, wherein step c) comprises applying the restrain air flow and lifting air flow substantially at the same time onto the sheet.

13. The method according to claim 11, wherein in step c) the lifting air flow comprises a separation air flow directed along a surface of the transport belt in a direction along the deflected belt at the deflection element towards the leading edge of the sheet for lifting a leading edge of the sheet from the transport belt.

14. The method according to claim 13, wherein in step c) the lifting air flow comprises a detach air flow directed through air permeable openings of the transport belt onto the contact side of the sheet for detaching the sheet from the transport belt, and wherein step c) comprises applying the separation air flow and the detach air flow substantially at the same time onto the contact side of the sheet.

15. The method according to claim 11, wherein in step c) the lifting air flow comprises a detach air flow directed through air permeable openings of the transport belt onto the contact side of the sheet for detaching the sheet from the transport belt.

16. The method according to claim 11, wherein step c) comprises controlling the at least two air flows in response to at least one sheet attribute of the sheet, wherein the at least one sheet attribute comprises a media characteristic of the sheet.

* * * * *